US007428924B2

(12) United States Patent
Patel

(10) Patent No.: US 7,428,924 B2
(45) Date of Patent: Sep. 30, 2008

(54) SYSTEM AND METHOD FOR COMPLETING A SUBTERRANEAN WELL

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 151 days.

(21) Appl. No.: 11/306,222

(22) Filed: Dec. 20, 2005

(65) Prior Publication Data

US 2006/0196660 A1 Sep. 7, 2006

Related U.S. Application Data

(60) Provisional application No. 60/593,231, filed on Dec. 23, 2004.

(51) Int. Cl.
*E21B 49/08* (2006.01)

(52) U.S. Cl. ..... 166/250.01; 166/205; 166/369; 166/316

(58) Field of Classification Search ..... 166/250.01, 166/250.15, 205, 369, 386
See application file for complete search history.

(56) References Cited

U.S. PATENT DOCUMENTS

| | | | | |
|---|---|---|---|---|
| 3,437,046 | A | 4/1969 | Tremain | |
| 3,677,665 | A | 7/1972 | Corkill | |
| 5,163,512 | A | 11/1992 | Brewer | |
| 5,671,809 | A | 9/1997 | McKinzie | |
| 5,697,441 | A | 12/1997 | Vercaemer | |
| 5,954,136 | A | 9/1999 | McHugh | |
| 6,006,832 | A * | 12/1999 | Tubel et al. | 166/250.01 |
| 6,135,210 | A | 10/2000 | Rivas | |
| 6,315,041 | B1 | 11/2001 | Carlisle | |
| 6,318,465 | B1 | 11/2001 | Coon | |
| 6,419,022 | B1 * | 7/2002 | Jernigan et al. | 166/336 |
| 6,460,619 | B1 | 10/2002 | Braithwaite | |
| 6,464,006 | B2 | 10/2002 | Womble | |
| 6,533,039 | B2 | 3/2003 | Rivas | |
| 6,588,266 | B2 | 7/2003 | Tubel | |
| 6,619,397 | B2 | 9/2003 | Coon | |
| 6,648,073 | B1 | 11/2003 | Jernigan | |
| 6,668,925 | B2 | 12/2003 | Shaw | |
| 6,854,517 | B2 | 2/2005 | Gay | |
| 6,863,124 | B2 | 3/2005 | Araux | |
| 7,040,390 | B2 * | 5/2006 | Tubel et al. | 166/64 |
| 2003/0127223 | A1 * | 7/2003 | Branstetter et al. | 166/250.15 |
| 2004/0020652 | A1 | 2/2004 | Campbell | |
| 2004/0043501 | A1 | 3/2004 | Means | |
| 2004/0112596 | A1 | 6/2004 | Williams | |
| 2004/0129418 | A1 | 7/2004 | Jee | |
| 2005/0149264 | A1 | 7/2005 | Tarvin | |

OTHER PUBLICATIONS

Schlumberger Oilfield Glossary, "Completions", http://www.glossary.oilfield.slb.com/Display.cfm?Term=completion.*

* cited by examiner

*Primary Examiner*—Jennifer H Gay
*Assistant Examiner*—Brad Harcourt
(74) *Attorney, Agent, or Firm*—Van Someren, PC; Jeremy P. Welch; Bryan P. Galloway

(57) ABSTRACT

A technique is provided for completing a subterranean wellbore. A wellbore completion combines a distributed sensing system, such as a distributed temperature sensing system, with at least one flow control valve and a pumping system. The flow control valve is controllable without the need for intervention or with low-cost intervention.

8 Claims, 5 Drawing Sheets

SYSTEM AND METHOD FOR COMPLETING A SUBTERRANEAN WELL

CROSS-REFERENCE TO RELATED APPLICATION

The present document is based on and claims priority to U.S. Provisional Application Ser. No. 60/593,231 filed Dec. 23, 2004.

BACKGROUND

Well completions are used in a variety of well related applications involving, for example, the production or injection of fluids. Generally, a wellbore is drilled, and completion equipment is lowered into the wellbore by tubing or other deployment mechanisms. The wellbore may be drilled through one or more formations containing desirable fluids, such as hydrocarbon based fluids.

In applications in which the wellbore has been formed through a plurality of formations, the wellbore often is divided into wellbore zones to better control the flow of fluid between each formation and the wellbore. Accordingly, it can be beneficial to have at least some control over the production of fluid from individual formations and/or over the injection of fluid into individual formations. The completion equipment may comprise devices, such as packers and multiple pumps, that can help control fluid flow with respect to each formation. However, the ability to efficiently control fluid flow in such subterranean environments while monitoring well conditions can be difficult.

SUMMARY

In general, the present invention provides a system and method for completing a subterranean well and enhancing efficient control over fluid flow from or to one or more formations. A completion is provided that can be used in subterranean wellbores having one or more zones. The completion comprises a distributed sensing system, such as a distributed temperature sensing system, and at least one flow control valve which can be controlled without the need for intervention or with low-cost intervention.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to completions deployed in wells for which control over flow of fluid along the wellbore is an enhanced. The system and methodology provide a way to easily control flow of fluid between one or more formations and the wellbore. In some applications, controlling the flow of fluid between the formations and the wellbore comprises controlling the flow of production fluids that are received by a wellbore completion from the surrounding formations. In other applications, controlling the flow of fluid between the formations and the wellbore comprises controlling the flow of injection fluids moving from the wellbore completion to surrounding formations. The wellbore completion incorporates components that facilitate control over this fluid flow without the need for expensive interventions conducted through the wellbore. In fact, complete control over the fluid flow can be exercised without any intervention or with low-cost intervention.

Referring to the Figures, several examples of a completion 10 are illustrated according to embodiments of the present invention. The Figures also illustrate the methodology of constructing and deploying the completions within a well 12. Generally, each embodiment of completion 10 comprises at least an upper completion section 14 and a lower completion section 16 operatively engaged with the upper completion section.

Figure 1:
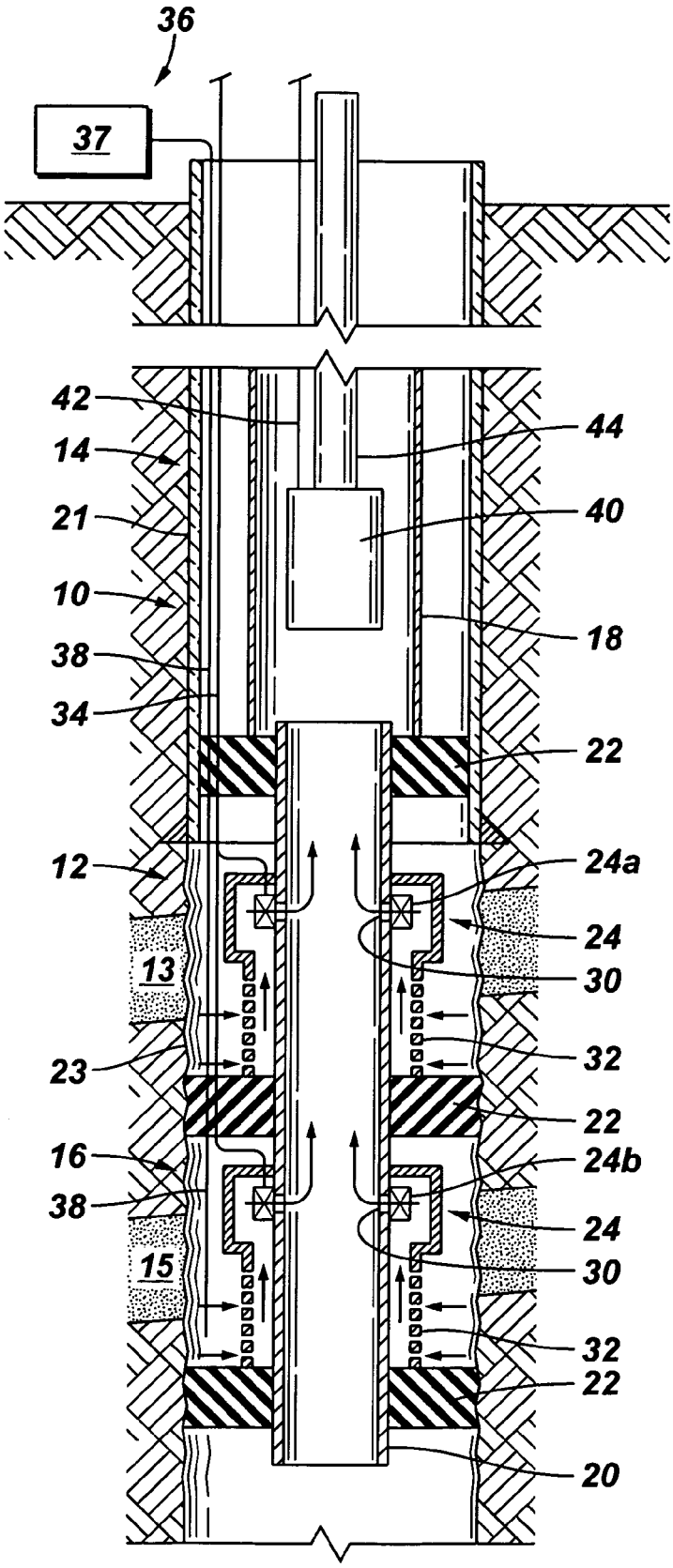
FIG. 1 is a front elevation view of a completion deployed in wellbore, according to an embodiment of the present invention.

Referring to the embodiment of FIG. 1, completion 10 is deployed in well 12 and comprises upper completion section 14 and lower completion section 16. In this embodiment, upper completion section 14 and lower completion section 16 are a cased portion and an open-hole portion, respectively. The well 12 intersects a plurality of formations, e.g. formations 13 and 15. In this example, completion 10 comprises a tubing string which acts as a shroud 18, a lower tubing 20, at least one packer 22, and at least one valve 24. The shroud 18 is positioned at the top of the uppermost packer 22 and may be attached to the top of uppermost packer 22.

As illustrated, lower tubing 20 extends through a plurality of packers 22. The uppermost packer 22 is typically deployed within a cased portion 21 of the wellbore, while the lower packers 22 are deployed within an open-hole portion 23 of the wellbore. In this arrangement, the uppermost packer 22 may be a completion packer 22, such as a ported completion packer, while the lower packers 22 may be zonal isolation open hole packers, e.g. swell packers.

As shown in FIG. 1, the well 12 intersects formation 13 between the uppermost packer 22 and the next lower packer 22, while the well 12 intersects formation 15 between the lower packers 22. Thus, the packers 22 isolate the formations 13 and 15 from each other, at least within the well 12. A plurality of valves 24 are disposed in completion 10 and located on the lower tubing 20 between the uppermost packer 22 and the next lower packer 22 and between the two lower packers 22.

One valve 24*a* therefore controls flow to and/or from formation 13, and the other valve 24*b* controls flow to and/or from formation 15. Each valve 24 provides selective communication from the annulus of the well 12 adjacent the relevant formation 13 and 15 to the interior of lower tubing 20 (such as via at least one port 30 through lower tubing 20). Each of the valves 24 may either be included on lower tubing 20 without additional equipment, or it may be integrated into additional equipment. For instance, the valves 24 shown in FIG. 1 are each integrated with a sand screen 32 so that the valves 24 selectively control the flow between the interior of the sand screen 32 and the interior of the lower tubing 20. The valves 24 may be actuated in several different ways, including wirelessly (wireless signals) actuated, mechanically actuated, electrically actuated or hydraulically actuated. FIG. 1 illustrates a hydraulic control line 34 deployed along the completion 10, through two of the packers 22 and to each of the valves 24. In this illustrated embodiment, the valves 24 are controlled via pressure changes, typically from a surface location, within the control line 34.

A distributed sensing system 36, such as a distributed temperature sensing system, is also deployed along completion 10. The sensing system 36 may comprise an optical fiber system including an optical fiber 38 that is extended along the length of the shroud 18 and through most if not all of the packers 22. A surface acquisition unit 37 may emit light pulses, read the signals reflected from the optical fiber 38, and determine the temperature profile across the formations 13 and 15 to analyze fluid flow related parameters, e.g. whether water break through has occurred at any point. If water break through occurs, a user may opt to shut off or choke the relevant valve 24 (such as by changing the pressure in control line 34). The optical fiber 38 may be deployed within a DTS control line, e.g. by pumping the fiber along the control line using a fluid.

In deployment of completion 10, the tubing string shroud 18, lower tubing 20, valves 24, packers 22, control line 34, and optical fiber 38 all are deployed together. When the uppermost packer 22 reaches the correct position, the packers 22 are set via, for example, mechanical actuation, hydraulical actuation, or by wireless input signal. An electric submersible pumping system 40 with a power cable 42 extending to the surface also may be deployed on a tubing 44, e.g. a work string or coiled tubing, to a position within shroud 18 and above the uppermost packer 22. The pumping system 40 may aid in artificially producing and lifting the formation fluids from formations 13 and 15.

Figure 2:
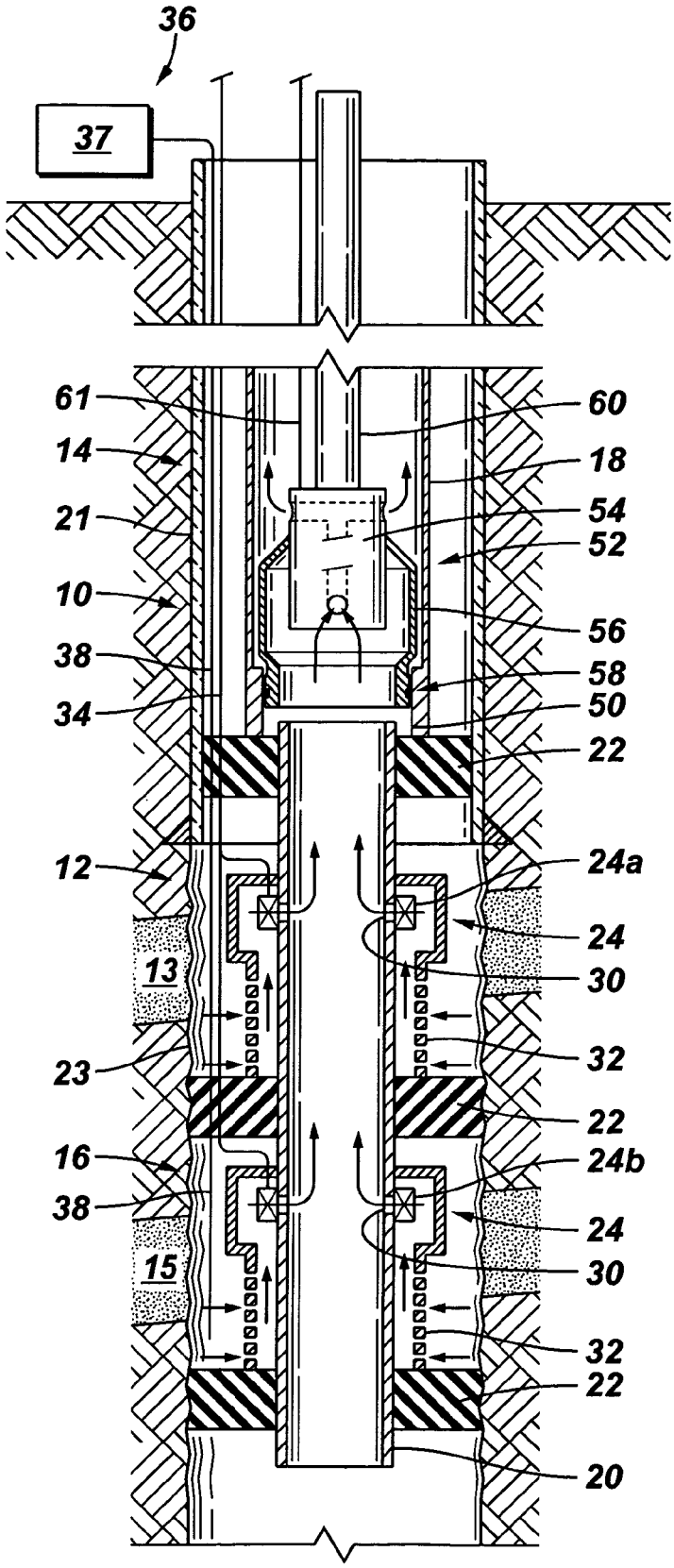
FIG. 2 is another embodiment of the completion illustrated in FIG. 1.

In the embodiment of FIG. 2, like elements are provided with the same reference numbers as the elements in FIG. 1. Many components of the embodiment of FIG. 2 are the same as that of FIG. 1, with certain differences as described below. For example, the shroud 18 of FIG. 2 includes a landing portion 50, such as a polished bore receptacle, which may be located directly above the uppermost packer 22. A pump assembly 52, including a pumping system 54, a pump shroud 56, and a seal assembly 58, is deployed within the shroud 18 by way of a deployment tubing 60 such as coiled tubing having a power cable 61 to supply power to pumping system 54. Pumping system 54 may be in the form of an electric submersible pumping system. The pump assembly 52 is deployed into the shroud 18 until the seal assembly 58 engages the landing portion 50 and creates a seal therewith. When activated, the pumping system 54 facilitates fluid flow from the formations 13 and 15, through the pump shroud 56, and annularly out of the pumping system 54 so the fluid is lifted externally of the deployment tubing 60 but within the shroud 18. The pump assembly 52 may be selectively deployed and removed from the completion 10.

With reference to FIG. 3, like elements again are provided with the same reference numbers as the elements in FIG. 1. In this embodiment, the lower completion 16 and the upper completion 14 are run in separate stages. Also, a wet connect is provided between the upper and lower completions, an embodiment of which is explained in greater detail below. The wet connect can comprise a hydraulic line through which an optical fiber is pumped, a fiber optic wet connect, an electrical wet connect useful for pressure gauges, temperature gauges, and flow control valves, or a hydraulic wet connect for providing hydraulic signals to, for example, a flow control valve. No shroud 18 is included in this embodiment. Also, a passageway may be provided through the upper completion for running a mechanical shifting tool to actuate flow control valves. Thus, the valves 24 can be mechanically actuated and a control line 34 is not included. Additionally, the optical fiber 38 or control line housing optical fiber 38 does not initially extend all the way to the surface. Instead, the fiber 38 and/or control line initially extend from a position above uppermost packer 22 through the packers 22 and across the formations 13 and 15. In this embodiment, the lower tubing 20 includes an enlarged portion 70 that extends through the uppermost packer 22. The enlarged portion 70 may include a polished bore receptacle 71.

When the packers 22 and lower tubing 20 are properly positioned downhole, an upper completion section 14 is lowered into the well 12. In this embodiment, upper completion 14 comprises a production tubing 74 with a bypass 76, a Y-block 77, an upper optical fiber or control line section 78, a seal assembly 80, and a lock portion 82. The lock portion 82 of the upper completion 72 mates and locks with a mating lock portion 83 positioned above uppermost packer 22, while the seal assembly 80 comes into sealing engagement with and within the enlarged portion 70 of lower tubing 20. Simultaneously, a wet connect section 84*a* of the upper optical fiber or control line section 78 moves into hydraulic communication with a mating wet connect section 84*b* connected with the optical fiber or control line 38. If only an optical fiber is included, then the wet connect is a fiber optic wet connect. If a control line is used to house the optical fiber, then the wet connect may be a hydraulic wet connect, and the optical fiber may subsequently be pumped along the interior of the joined control line. In other applications, the wet connect also can be a hydraulic wet connect for providing hydraulic signals or an electrical wet connect. The mating lock portions 82 and 83 also may function to guide and orient the wet connect sections 84*a* and 84*b* into proper engagement.

A pumping system 86 is located within the Y-block 77, and may be removably inserted by use of the bypass 76 and a kick out tool (not shown), as known in the art. The entire upper completion 14 may thus be selectively inserted and integrated with the remainder of the completion 10, e.g. lower completion section 16. Moreover, since the pumping system 86 is located in the Y-block 77, a shifting tool (not shown) may be deployed through the main bore of the production tubing 74 and into the lower tubing 20 to mechanically shift the positions of the valves 24 as needed.

Figure 3:
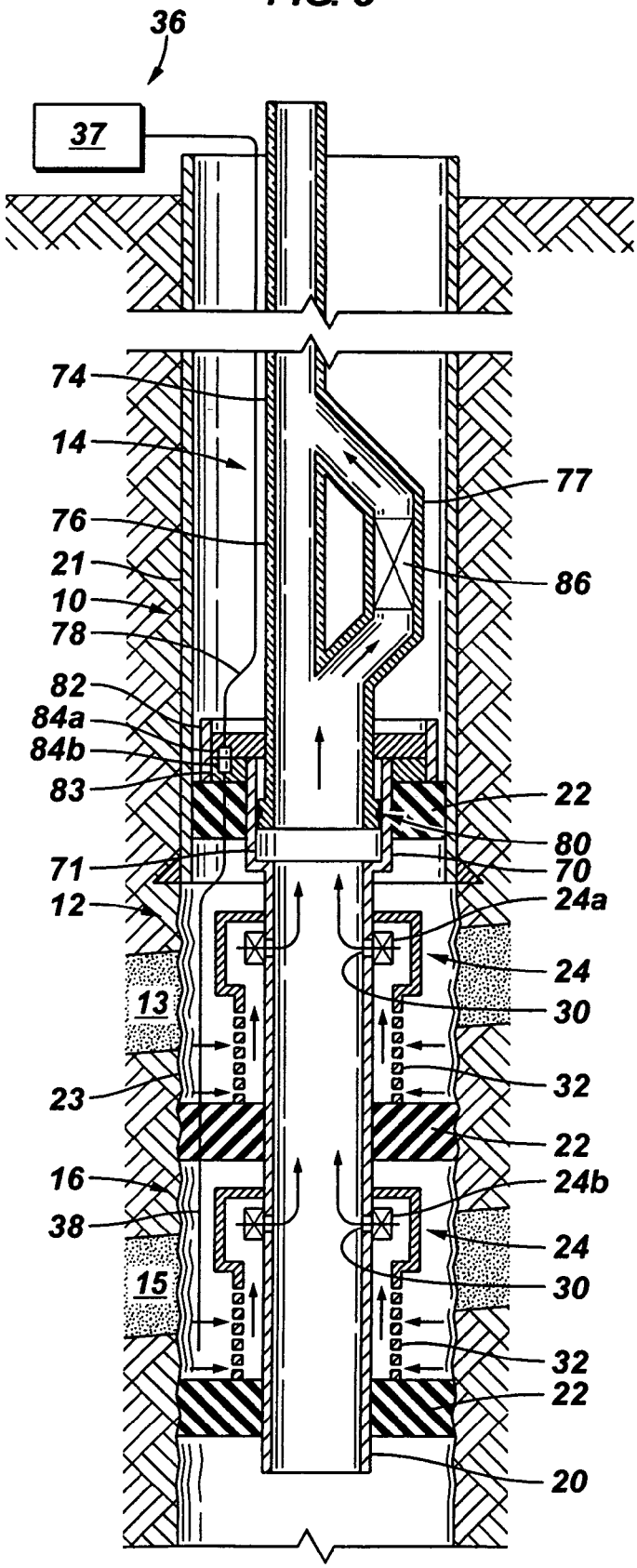
FIG. 3 is another embodiment of the completion illustrated in FIG. 1.
Figure 4:
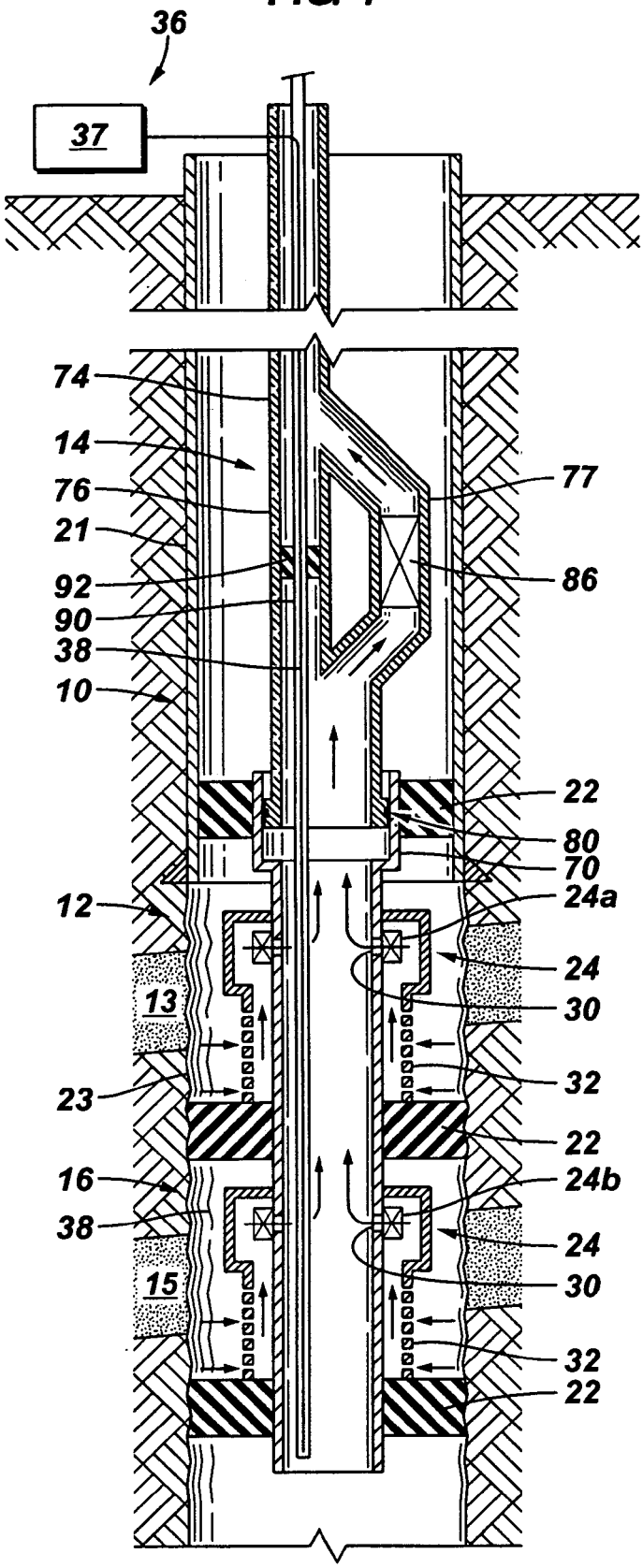
FIG. 4 is another embodiment of the completion illustrated in FIG. 1.

In the embodiment of FIG. 4, like elements are provided with the same reference numbers as the elements in FIG. 3. In this embodiment, however, the sensing system 36 is deployed within the production tubing 74 and the lower tubing 20. Also in this embodiment, the sensing system 36 further comprises a stinger 90, such as a coiled tubing stinger, with the optical fiber 38 or control line housing the optical fiber 38 deployed therein. The stinger 90 is sealed off within the main bore of production tubing 74 by use of a pack off 92 positioned between the stinger 90 and the surrounding wall of bypass 76. The stinger 90 may be deployed together with the upper completion section 14 or after the deployment of the upper completion section 14. In any case, the stinger 90 and enclosed optical fiber 38 extend within lower tubing 20 across formations 13 and 15.

Figure 5:
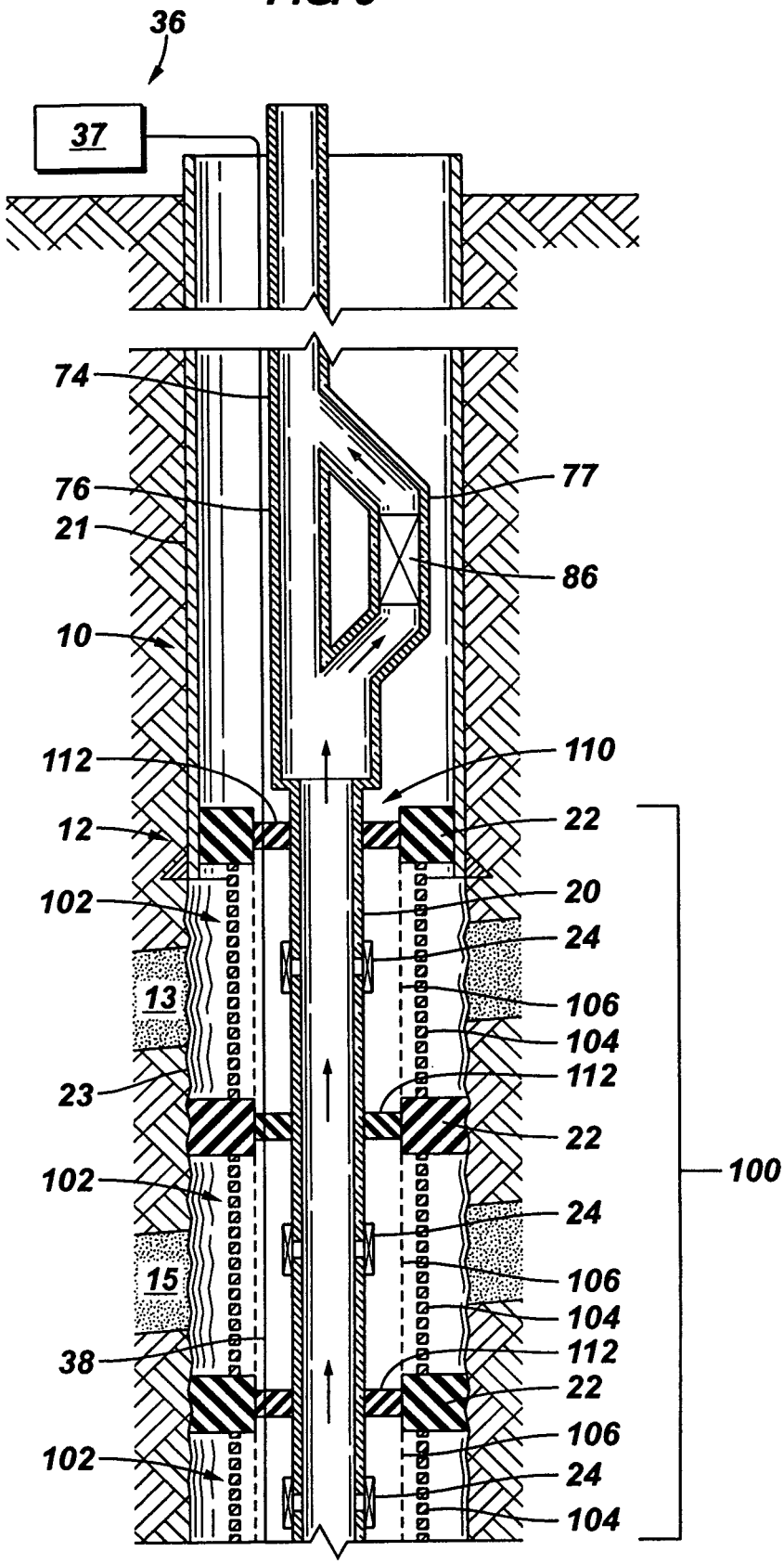
FIG. 5 is another embodiment of the completion illustrated in FIG. 1.

The embodiment of completion 10 shown in FIG. 5 is somewhat different than the previous embodiments, although it provides certain similar functionalities as the previous embodiments. As an initial deployment stage, a sand control section 100 is deployed in the well 12. Like the previous embodiments, sand control section 100 includes packers 22 that seal and anchor the sand control section 100 to the cased portion 21 and open-hole portion 23 of the well 12. Sand control section 100 comprises at least one sand control screen 102, each of which includes a sand screen 104 and a screen base pipe 106 (as are commonly known in the art).

Completion 10 also comprises a stinger section 110, which is subsequently deployed and is inserted into the sand control section 100. The stinger section 110 includes the lower tubing 20 that is attached to the production tubing 74, which, in turn, includes Y-block 77, pump 86, and bypass 76. Mechanical valves 24 are disposed along the lower tubing 20 so that each valve 24 is in communication with a corresponding formation, e.g. formations 13 or 15, once the stinger section 110 is properly inserted into the sand control section 100. In this embodiment, valves 24 may comprise mechanical sliding sleeves or hydraulically or electrically actuated flow control valves. At least one seal assembly 112 also is deployed along the lower tubing 20, so that seal assemblies 112 may be located to isolate the sections between valves 24, thereby isolating the formations 13 and 15. In one embodiment, each seal assembly 112 sealingly and slidingly engages the exterior of lower tubing 20 to provide the necessary isolation. In one embodiment, each seal assembly 112 seals against the lower tubing 20 adjacent a corresponding packer 22.

The optical fiber 38 or control line that houses such fiber is deployed with the stinger section 110. In the illustrated embodiment, the fiber or control line is deployed through ports in the seal assemblies 112 and extends from the surface downward across the formations 13 and 15.

Each of the embodiments of completion 10 described herein facilitates the completion of a multizone subterranean wellbore and the easy operation of the well. The completion includes combinations of components that can be moved downhole as a single completion or as completion sections having various completion components incorporated therein. Each completion embodiment combines the use of a distributed sensing system, such as a distributed temperature sensing system, with at least one flow control valve that is readily controlled without intervention or with low-cost intervention. This combination facilitates the efficient operation of a wide variety of wells.

Furthermore, each completion 10 may comprise a pumping system that enables the artificial lifting and production of fluids from formations 13 and 15. In each of these embodiments, the pumping system is selectively removable from the completion without requiring the removal of the remainder of the completion 10 from the wellbore.

The combination of packers 22 (seal assemblies 112 in FIG. 5) and valves 24 further facilitate efficient operation of the well. The packers 22 enable selective isolation of both cased and open hole sections of the well adjacent multiple formations. The valves 24 cooperate with the packers 22 to enable the independent control of the flow from (or to) the formations, e.g. formations 13 and 15, with little or no intervention. The valves 24 of FIGS. 1 and 2 are hydraulically actuated and can therefore be choked, closed, or opened without intervention. The valves 24 of FIGS. 3-5 are mechanically actuated and can therefore be choked, closed, or opened with minimal intervention. The use of a Y-block 77 in the embodiments of FIGS. 3-5 enables the valve intervention without the need to remove any part of completion 10 and while maintaining the pumping system downhole, if desired. The valves 24 may be stand alone (see FIG. 5) or may be integrated with other equipment, such as sand screens (see FIGS. 1-4).

The completions 10 also are designed such that a distributed sensing system 36, e.g. a distributed temperature sensing system, may be deployed downhole as part of any of the completions 10. The sensing system 36 enables the monitoring of fluid flow parameters related to the movement of fluid along the wellbore to provide the well operator with feedback. This feedback enables the well operator to adjust valves 24 to ensure productive operation of the well is maintained without detrimental events, such as water break through. In some embodiments, the sensor system 36 can be wholly deployed with at least a portion of the completion 10. In other embodiments, the sensor system 36 can be deployed in sections that are connected downhole by, for example, a wet connect.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A completion for use in a subterranean wellbore, comprising:

a lower tubing including a pair of valves adapted to be deployed in the wellbore;

the lower tubing being sealing engaged to at least one packer;

the pair of valves being disposed below the at least one packer and to control flow from at least two formations;

an upper completion section including a pump adapted to be selectively and removably deployed in the wellbore, wherein the upper completion section comprises a production tubing having a bypass and a Y-block, the pump being located in the Y-block; and a distributed sensing system extending across at least one formation.

2. The completion as recited in claim 1, wherein the distributed sensing system comprises a distributed temperature sensing system at least partially disposed within the production tubing.

3. The completion as recited in claim 2, wherein the distributed temperature sensing system comprises an optical fiber deployed within a stinger.

4. A method for completing a subterranean wellbore, comprising:

deploying a lower tubing in the wellbore proximate a formation;

functionally sealing the lower tubing to the wellbore by use of a first packer and a second packer in the wellbore;

disposing a first valve between the first packer and the second packer and a second valve below the second packer;

selectively and removably deploying a pump in the wellbore;

measuring a temperature profile across the at least one formation; controlling fluid flow between the formation and the lower tubing with the at least one valve; and engaging the lower tubing with a production tubing having a bypass and a Y-block; and positioning the pump in the Y-block.

5. A method for completing a subterranean wellbore, comprising:

deploying a lower tubing in the wellbore proximate a formation; functionally sealing the lower tubing to the wellbore utilizing a ported completion packer as an uppermost packer and a plurality of open hole packers positioned below the ported completion packer;

disposing at least one valve on the lower tubing and below the ported completion packer;

selectively and removably deploying a pump in the wellbore; measuring a temperature profile across the at least one formation;

controlling fluid flow between the formation and the lower tubing with the at least one valve wherein the uppermost packer has an upper completion section comprising a production tubing having a bypass and a Y-block, a pump being located in the Y-block.

6. A system for completing a subterranean wellbore, comprising:

a first packer deployed in a cased section of a wellbore;

a second packer deployed below the first packer in an open hole section of the wellbore to isolate a first wellbore zone from a second wellbore zone;

a lower completion section having a tubing with a plurality of valves controllable without substantial intervention, at least a first valve of the plurality of valves being disposed between the first packer and the second packer and at least a second valve being disposed below the second packer;

an upper completion section engaging the lower completion section and having an electric submersible pumping system to move a fluid through the tubing and a shroud surrounding the electric submersible pumping system; wherein the shroud comprises a landing portion proximate the first packer to sealably receive a pump shroud extending downwardly from the electric submersible pumping system; and a distributed temperature sensing system extending past the first packer, the second packer and the plurality of valves to detect well parameters related to movement of the fluid.

7. A system for completing a subterranean wellbore, comprising:

a first packer deployed in a cased section of a wellbore;

a second packer deployed below the first packer in an open hole section of the wellbore to isolate a first wellbore zone from a second wellbore zone;

a lower completion section having a tubing with a plurality of valves controllable without substantial intervention, at least a first valve of the plurality of valves being disposed between the first packer and the second packer and at least a second valve being disposed below the second packer;

an upper completion section engaging the lower completion section and having (1) an electric submersible pumping system to move a fluid though the tubing, (2) a shroud surrounding the electric submersible pumping system, and (3) a production tubing having a bypass and a Y-block in which the electric submersible pumping system is positioned; and a distributed temperature sensing system extending past the first packer, the second packer and the plurality of valves to detect well parameters related to movement of the fluid.

8. A system for completing a subterranean wellbore, comprising:

a first packer deployed in a cased section of a wellbore;

a second packer deployed below the first packer in an open hole section of the wellbore to isolate a first wellbore zone from a second wellbore zone;

a lower completion section having a tubing with a plurality of valves controllable without substantial intervention, at least a first valve of the plurality of valves being disposed between the first packer and the second packer and at least a second valve being disposed below the second packer;

an upper completion section engaging the lower completion section and having an electric submersible pumping system to move a fluid through the tubing; and a distributed temperature sensing system to detect well parameters related to movement of the fluid and comprising a stinger extending through the first packer, the second packer and the plurality of valves wherein the first packer has an upper completion section comprising a production tubing having a bypass and a Y-block, a pump being located in the Y-block.

* * * * *